United States Patent [19]

Ishida et al.

[11] Patent Number: 4,641,947

[45] Date of Patent: Feb. 10, 1987

[54] HOUSING APPARATUS

[75] Inventors: Takao Ishida, Kawasaki; Mamoru Shimono, Yokohama, both of Japan

[73] Assignee: Tokyo Shibaura Denki Kabushiki Kaisha, Kawasaki, Japan

[21] Appl. No.: 829,455

[22] Filed: Feb. 11, 1986

Related U.S. Application Data

[63] Continuation of Ser. No. 521,827, Aug. 10, 1983, abandoned.

[30] Foreign Application Priority Data

Aug. 20, 1982 [JP] Japan ..... 57-144473

[51] Int. Cl.[4] ..... G03G 15/00; G03G 21/00

[52] U.S. Cl. ..... 355/3 R; 267/169; 355/75

[58] Field of Search ..... 355/3 R, 3 SH, 14 SH, 355/75; 312/319; 267/64.11, 169, 173

[56] References Cited

U.S. PATENT DOCUMENTS

| | | | |
|---|---|---|---|
| 2,822,568 | 2/1958 | Hosea | 267/173 X |
| 3,671,094 | 6/1972 | Turner et al. | 312/319 |
| 3,870,287 | 3/1975 | McMahon | 267/64.11 X |
| 3,997,262 | 12/1976 | Doi et al. | 355/3 R X |
| 4,010,882 | 3/1977 | Turner | 355/75 X |
| 4,124,296 | 11/1978 | Kishi et al. | 355/75 |
| 4,240,619 | 12/1980 | Wirges et al. | 267/64.11 |
| 4,365,893 | 12/1982 | Kimura et al. | 355/75 |
| 4,412,734 | 11/1983 | Shibuya et al. | 355/3 SH |

*Primary Examiner*—Fred L. Braun

*Attorney, Agent, or Firm*—Cushman, Darby & Cushman

[57] ABSTRACT

A housing apparatus having first and second housings is provided with an arm section extending from the first housing onto the second housing and having a free end portion. The arm section has a coupling portion rockably supported on the second housing portion, and a free end portion extending from the first housing onto the second housing. The free end portion is coupled to an urging device disposed on the second housing portion. The urging device applies a predetermined urging force to the free end portion when the first housing is rotated around the coupling portion by a predetermined angle from the second housing so that the first housing is maintained in a predetermined position in which a space is formed between the first and second housings, when the first housing is swung around the coupling portion by a predetermined angle from the second housing.

20 Claims, 17 Drawing Figures

HOUSING APPARATUS

This is a continuation of application Ser. No. 521,827, filed Aug. 10, 1983, which was abandoned upon the filing hereof.

BACKGROUND OF THE INVENTION

The present invention relates to a housing apparatus used in, for example, an electronic copying machine of the so-called shell type, in which the housing of the apparatus is divided into upper and lower units.

Conventionally known are electronic copying machines of the so-called shell type which are provided with a housing apparatus. The housing of the housing apparatus is divided into upper and lower units (or first and second housing) so that the upper unit can be swung against the lower unit. Thus, the housing can be easily opened to facilitate removal of jams.

As shown in FIG. 1, one such prior art housing apparatus 1 comprises an upper unit 2 and a lower unit 4. A conveyor path 6 is formed between the upper unit 2 and lower unit 4. One end portion of the upper unit 2 is rockably supported on one end portion of the lower unit 4 by means of a shaft 5. Coil springs 8 are stretched between the respective central portions of the upper and lower units 2 and 4, crossing the conveyor path 6. The coil springs 8 normally urge the upper unit 2 in the direction of arrow Z so that the upper unit 2 is lifted or rotated from the lower unit 4 to define a space 9 between the two units 2 and 4. In this conventional housing apparatus, if a jam is caused in the conveyor path, an operator releases a lock mechanism (not shown) to force up the upper unit 2 so that the conveyor path is exposed and the space 9 is formed. Then, the operator removes the cause of the jam through the space 9. In the conventional housing apparatus, however, the coil springs 8 are arranged in positions such that they cross the space 9, so that they constitute a hindrance to the removal of the jam from the side of the apparatus, to replacement of components and to other maintenance work.

SUMMARY OF THE INVENTION

The object of the present invention is to provide a housing apparatus facilitating maintenance work, such as removal of jams, replacement or inspection of components, etc.

According to an aspect of the present invention, there is provided a housing apparatus which comprises a first housing, a second housing, an arm section extending from the first housing onto the second housing and having a free end portion, coupling means for swingably coupling the arm section to the second housing to support the first housing, urging means provided on the second housing and coupled to the free end portion of the arm section, said urging means applying a predetermined urging force to the free end portion of the arm section to maintain the first housing in a predetermined position in which a space is formed between the first and second housings, when the first housing is swung around the coupling means by a predetermined angle from the second housing.

DETAILED DESCRIPTION OF THE PREFERRED EMBODIMENTS

Several embodiments of the present invention will now be described in detail with reference to the accompanying drawings.

Referring first to FIGS. 2 to 7, a first embodiment of the invention will be described in detail.

Figure 1:
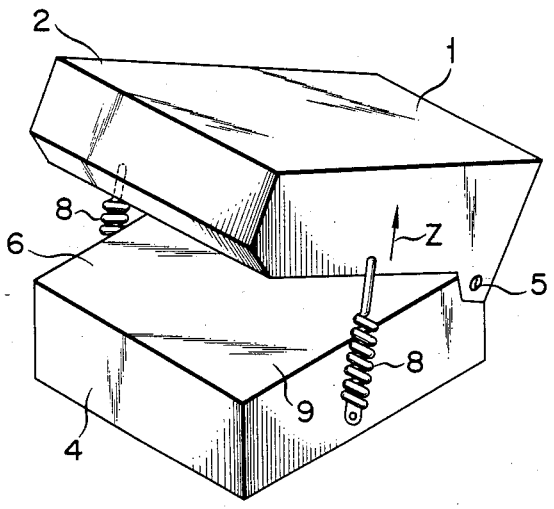
FIG. 1 PRIOR ART
FIG. 1 is a perspective view schematically showing a prior art housing apparatus.
Figure 2:
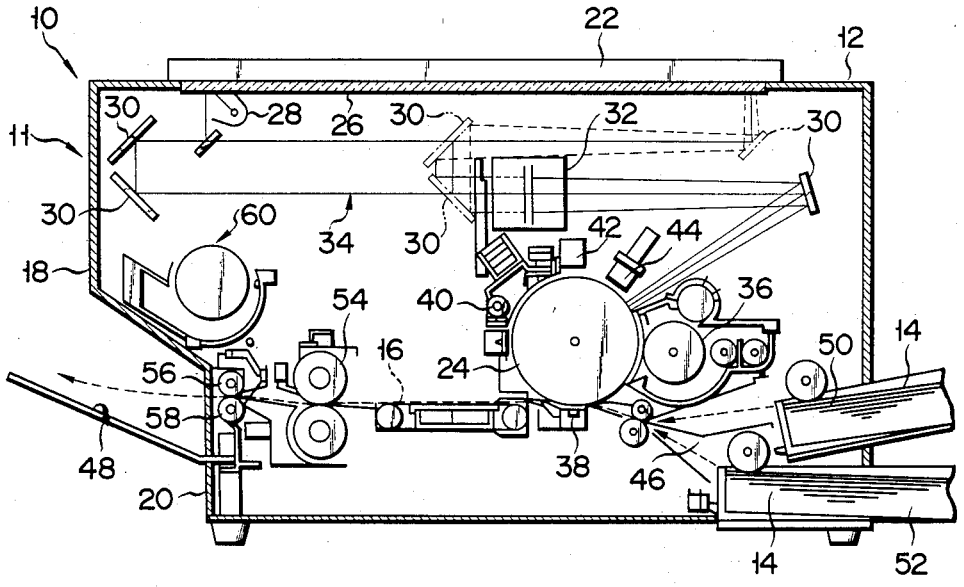
FIG. 2 is a side sectional view schematically showing an electronic copying machine using a housing apparatus according to a first embodiment of the present invention.

FIG. 2 shows an electronic copying machine 10 of the so-called shell type using a housing apparatus 11 according to the first embodiment of the invention. The electronic copying machine 10 has a housing or body 12 which consists of an upper unit (first housing) 18 and a lower unit (second housing) 20. The upper and lower units 18 and 20 are divided by a conveyor path (indicated by broken line) 16 through which copying paper 14 is fed. Generally liable to jam, the conveyor path 16 may be exposed when the two units 18 and 20 are separated from each other. The body 12 carries thereon a turnable cover 22 which holds an original paper (not shown) to be copied. A photosensitive body 24 is rotatably supported in the central portion of the interior of the body 12 so that an electrostatic latent image is formed on the surface of the photosensitive body 24 by a light beam applied thereto. Between the photosensitive body 24 and the cover 22 lies an exposure mechanism 34 which comprises an original table 26 carrying the original paper thereon, a lamp 28 for irradiating the original table 26, mirrors 30 for reflecting a light beam from the original table 26 on the photosensitive body 16, and a lens unit 32 for reducing or magnifying images. Adjacent to the photosensitive body 24 is a developing device 36 for developing an electrostatic latent image formed on the photosensitive body 24 by applying a toner to the image, and a transfer device 38 for transferring a toner image on the surface of the photosensitive body 24 to the copying paper 14. Also adjacent to the photosensitive body 24 is a cleaning device 40 for removing the toner on the photosensitive body 24, a deelectrifier 42 for removing the electrostatic latent image on the photosensitive body 24, and a charger 44.

The starting end of the conveyor path 16 is coupled to a paper feeder 46 which is located at one side portion of the lower unit 20 to feed the copying paper 14 to the conveyor path 16, while the extreme end of the conveyor path 16 extends to an outlet tray 48 which receives discharged copies. The paper feeder 46 is provided with paper cassettes 50 and 52 containing the copying paper 14. A fixing device 54 for fixing the toner to the copying paper 14 and delivery rollers 56 and 58 are arranged near the extreme end of the conveyor path 16. A cooling fan unit 60 is disposed over the delivery rollers 56 and 58.

Figure 3:
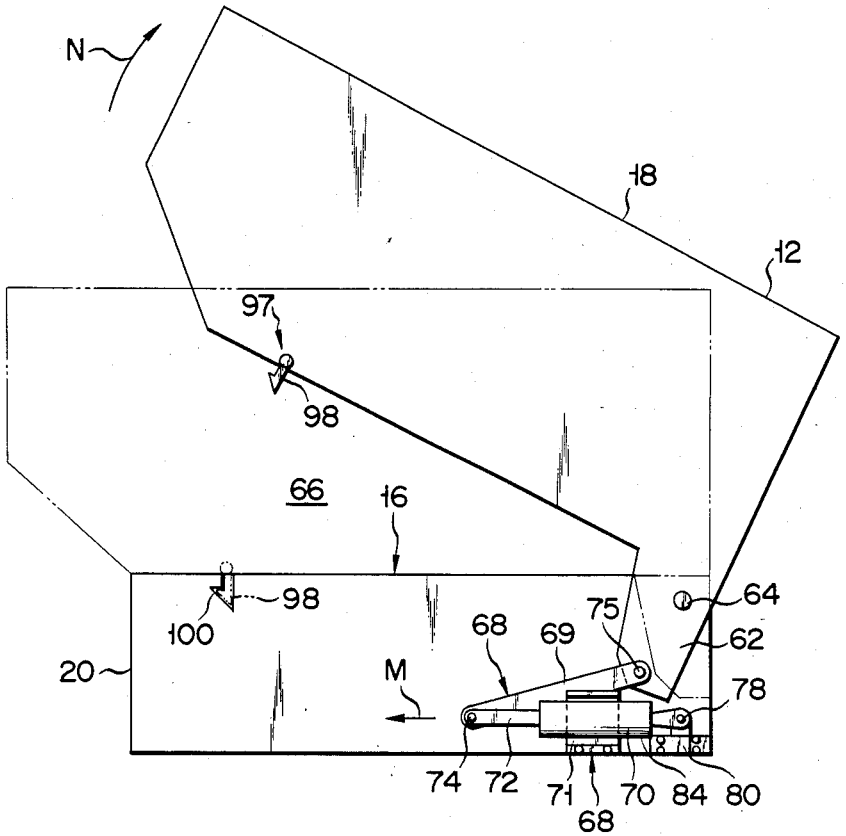
FIG. 3 is a side view schematically showing the housing apparatus according to the first embodiment of the invention used in the electronic copying machine shown in FIG. 2.

FIG. 3 is a schematic side view of the electronic copying machine 10, in which the cover (not shown) overlying the body or housing 12 is removed. The upper unit 18 is integrally provided at one end portion thereof with an arm (arm section) 62 which extends toward the lower unit 20 beyond the conveyor path 16. The proximal end portion (coupling means) of the arm 62 near the conveyor path 16 is rockably supported on the lower unit 20 by means of a shaft 64. Thus, when the upper unit 18 is swung up from the lower unit 20, the conveyor path 16 defined between the two units 18 and 20 is exposed, and a space 66 is defined. The extreme end portion (free end portion) of the arm 62 is coupled by means of a link 69 to an urging device (urging means) 68 which urges the arm 62 so that the upper unit 18 is swung in the direction of arrow N. The urging device 68 includes a gas spring 70 from one side of which extends a piston rod 72. The gas spring 70 is fixed to the lower unit 20 by a fixing member 71 so as to extend parallel to the conveyor path 16. One end portion 74 of the piston rod 72 of the gas spring 70 is coupled to one end portion of the link 69. The other end portion 75 of the link 69 is coupled to the extreme end portion of the arm 62. From the other side of the gas spring 70 protrudes a fitting portion 78 whereby the gas spring 70 is mounted for reinforcement on a fitting member 80 fixed to the lower unit 20.

Figure 4:
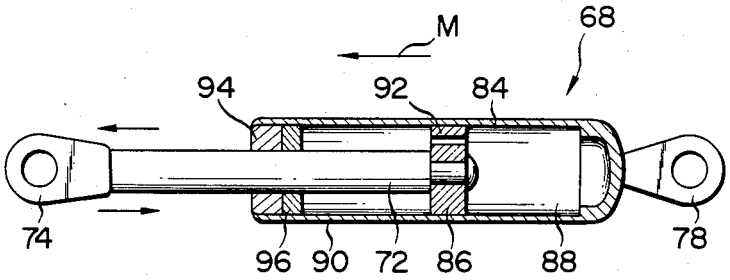
FIG. 4 is a schematic sectional view of a gas spring used in the housing apparatus shown in FIG. 3.

Referring now to FIG. 4, the gas spring 70 used in the first embodiment will be described. Inside a cylinder 84 of the gas spring 70, a piston 86 is integrally formed on the other end of the piston rod 72 for axial sliding. The interior of the cylinder 84 is divided into first and second chambers 88 and 90 by the piston 86. The first and second chambers 88 and 90 are filled with compressed gas such as nitrogen gas. The first and second chambers 88 and 90 connect with each other by means of an orifice 92 bored through the piston 86. The orifice 92 controls the movement of the piston 86 or the movement of the gas in the cylinder 84. Namely, the piston 86 is slowed down as the orifice 92 is reduced in diameter. Lubricating oil is sealed in the cylinder 84 to smooth the movement of the piston rod 72. A rod guide 94 is provided in the cylinder 84, defining the second chamber 90 and guiding the piston rod 72 in movement. A seal 96 for sealing the lubricating oil and the compression gas in the cylinder 84 is provided between the rod guide 94 and the piston 86.

Figure 5:
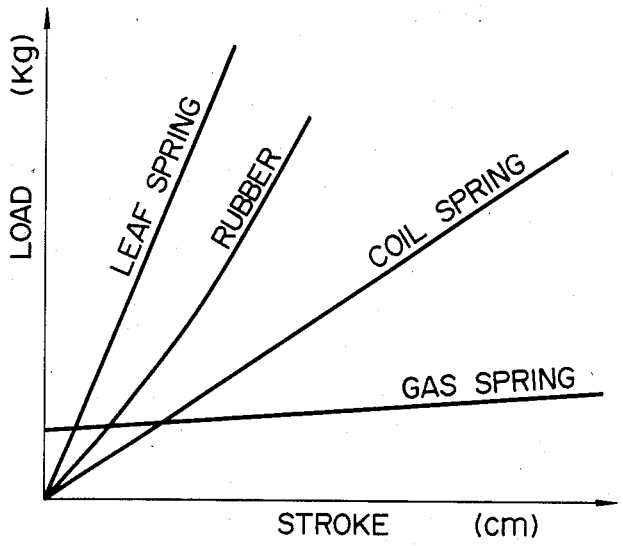
FIG. 5 is a graph showing the relationship between the load and stroke of springs of various kinds.

In the gas spring with this arrangement, the stationary-state internal pressures of the first and second chambers 88 and 90 are normally equal, since the two chambers 88 and 90 connect each other by means of the orifice 92. The area of the face of the piston 86 subject to a pressure on the side of the first chamber 88 is greater by the sectional area of the piston rod 72 than that of the face subject to a pressure on the side of the second chamber 90. Accordingly, the gas in the cylinder 84 normally urges the piston 86 in the direction of arrow M. The volume or pressure of the gas in the cylinder 84 depends on the volume of that portion of the piston rod 72 inside the cylinder 84 which varies as the piston rod 72 slides. When the piston 86 is on the side of the seal 96 (on the left-hand side in FIG. 4), the volume of the gas in the cylinder 84 is larger, that is, the gas pressure inside the cylinder 84 is low. Therefore, the force urging the piston 86 in the direction of arrow M is small. When the piston 86 on the side of the fitting portion 78 (on the right-hand side in FIG. 4), on the other hand, the volume of the gas in the cylinder 84 is small, that is, the gas pressure inside the cylinder 84 is high. Therefore, the force urging the piston 86 in the direction of arrow M is great. The gas spring has a smaller spring constant and a higher initial load than those of springs of any other types, as shown in FIG. 5. Thus, the gas spring has an advantage such that it can gradually urge and move load.

As shown in FIG. 3, the body or housing 12 is provided with a lock mechanism 97 for holding the upper and lower units 18 and 20 closed. The lock mechanism 97 includes a substantially L-shaped retaining click 98 which is rockably supported on the interface side of the upper unit 18. At the lower unit 20 a recess 100 for engaging with the retaining click 98 is formed, which is located corresponding to the retaining click 98. As a handle (not shown) is rocked, the lock mechanism 97 rocks the retaining click 98 to engage with or disengage from the recess 100. As a result, the upper unit 18 is locked to the closed position relative to the lower unit 20, or is opened to define the space 66.

Now the operation of the first embodiment will be described.

If the conveyor path 16 becomes jammed while the electronic copying machine 10 is in operation (with the upper unit 18 closed), or in the maintenance of the copying machine 10, the copying machine 10 is stopped, and the handle (not shown) is operated to release the lock mechanism 97. Thereupon, the piston rod 72 is moved in the direction of arrow M by the urging force of the gas spring 70, and the upper unit 18 is swung up in the direction of arrow N through the medium of the link 69 and the arm 62 to define the space 66. When the upper unit 18 is swung up by a predetermined angle $\theta$, however, the urging force of the gas spring 70 balances with the moment of a force the upper unit 18 applies to the gas spring 70, and the upper unit 18 is stopped from swinging. In resuming the normal state (operating state) after the maintenance or other work, the upper unit 18 is pressed down to close the space 66 between the upper and lower units 18 and 20, and the lock mechanism 97 is engaged.

According to this first embodiment, there is no member to block the space 66 when the upper unit 18 is open, so that it is easy to remove the cause of jam or to conduct maintenance operations. The absence of the obstruction in the space 66 is expressly beneficial in taking out the photosensitive body 24 and other members which are bulky and fragile. According to this embodiment, moreover, the urging device 68 is attached to one corner portion of the lower unit 20, requiring only a narrow setting space and constituting no hindrance to other components.

Figure 6:
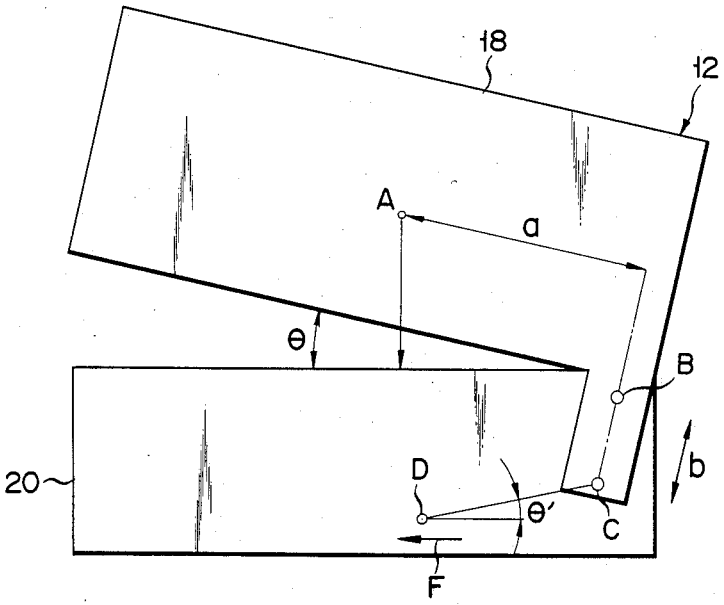
FIG. 6 is a schematic side view for illustrating the mechanism of the housing apparatus shown in FIG. 3.
Figure 7:
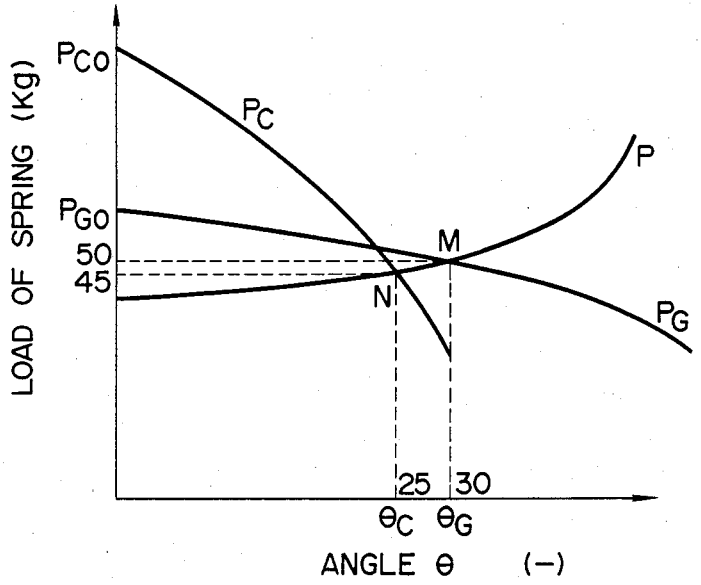
FIG. 7 is a graph showing the relationships between the opening angle $\theta$ and spring urging force for a comparison between a coil spring and a gas spring.

Referring now to FIGS. 6 and 7, there will be described the relationship between the urging force of the gas spring 70 and the load of the upper unit 18 acting on the gas spring 70. The upper and lower units 18 and 20 are in the balanced positions forming the space 66, as shown in FIG. 6, if we have $$Fb \cdot \cos\theta' \cos(\theta+\theta') = Wa \cdot \cos\theta \quad (1)$$

where W is the weight of the upper unit 18 falling on the center of gravity A, a is the length of a perpendicular from the center of grativy A to a straight line passing through a supporting point B (shaft 64) and a point of action C (end portion 75), b is the distance between the supporting point B and the point of action C, D is the junction (end portion 74) of the line 69 and the piston rod 72, $\theta$ is an angle formed between the upper and lower units 18 and 20, $\theta'$ is an angle formed between the link 69 and the piston rod 72, and F is an urging force acting on the gas spring 70.

If the left side is greater than the right side in Eq. (1), the upper unit 18 rocks in the direction of arrow N (FIG. 3) to open the body 12. If the left side is smaller than the right side, then the body 12 is closed. An opening load P required in keeping the body 12 open with the angle $\theta$ is given by $$P = F = cW \cdot \cos\theta / \cos\theta' \cos(\theta+\theta') \quad (2)$$

where $c = a/b$. The urging force F of the gas spring can be set by calculation on Eq. (2) based on a desired preset opening angle $\theta$. The urging force, F of the gas spring can be adjusted by, for example, changing the diameter of the piston rod 72 or changing the pressure of gas filled in the cylinder.

FIG. 7 shows the relationship between the opening angle $\theta$ and the opening load P. In FIG. 7, curves $P_C$ and $P_G$ represent the urging forces of a coil spring and the gas spring, respectively, produced with use of the opening angle $\theta$. In the graph of FIG. 7, a curve P represents an urging force or load which, required for the balance with the opening angle $\theta$, increases as the angle $\theta$ increases. Namely, the regions above and below the curve P correspond to ranges in which opening of the body 12 is allowed and prohibited, respectively. The urging force of the gas spring is at a maximum when the angle $\theta$ is zero, and is reduced as the angle $\theta$ increases. The intersection M (at opening angle of approx. 30°, urging force of approx. 50 kg/cm$^2$) of the curves P and $P_G$ is the point at which the load urging the upper unit 18 to be closed balances with the load (urging force of the gas spring) urging the upper unit 18 to be opened. Likewise, the intersection N (at opening angle of approx. 25°, urging force of approx. 45 kg/cm$^2$) of the curves P and $P_C$ is the point at which the urging force of the coil spring balances with the load urging the upper unit 18 to be closed. Thus, if the gas spring is used for the urging device, the upper unit 18 is kept open at the intersection M. On the other hand, if the coil spring is used for the urging device, as mentioned later, then the upper unit 18 is kept open at the intersection N.

According to the first embodiment, the gas spring is used for the urging device, so that the following effects may be obtained.

(1) Since the gas spring has a spring constant smaller than those of any other springs, it affords the increase of the opening angle $\theta$.

(2) Since the load required in opening the closed upper unit 18 is relatively small, only a small impact is caused, and the load required in closing the upper unit 18 can be reduced.

(3) Since the urging force provided when the angle $\theta$ is zero is small, the load on the lock mechanism 97 is small. Thus, the necessary strength for the lock mechanism 97 can be reduced.

Figure 8:
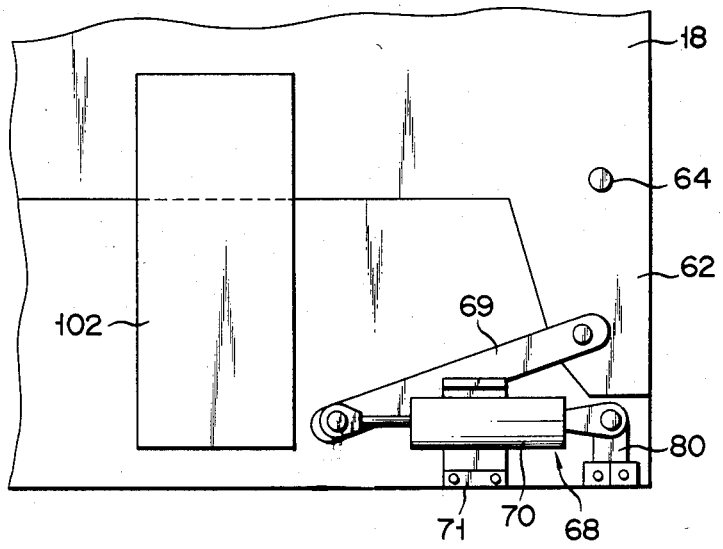
FIGS. 8 and 9 are partial side views of the housing apparatus for illustrating advantages of the first embodiment.
Figure 9:
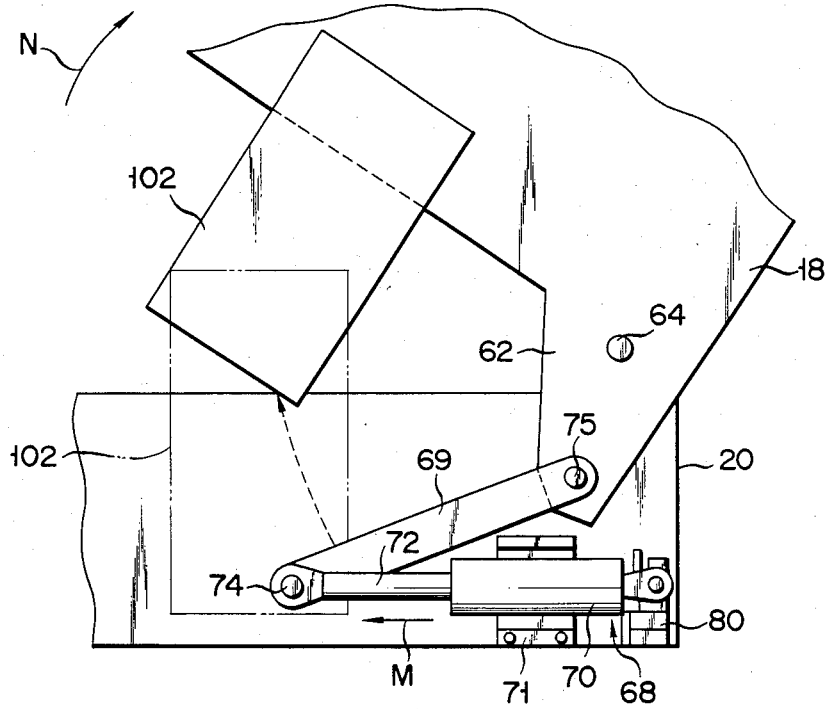

(4) Where an accessory 102 is attached to, for example, the upper unit 18, as shown in FIGS. 8 and 9, the gas spring 70 is short when the upper unit 18 is closed (FIG. 8), and is long when the upper unit 18 is open (FIG. 9). Therefore, the gas spring 70 will never interfere with the accessory 102. Thus, the space in the vicinity of the piston rod 72 of the gas spring 70 can be used effectively.

(5) When using the gas spring, the necessary stroke for the prescribed urging force is shorter than the stroke required when the coil spring is used. Therefore, the space near the piston rod 72 of the gas spring 70 can be used effectively.

(6) Using gas, the gas spring 70 is light in weight. Accordingly, the necessary strength of the supporting portion for the gas spring 70 can be reduced.

Figure 10:
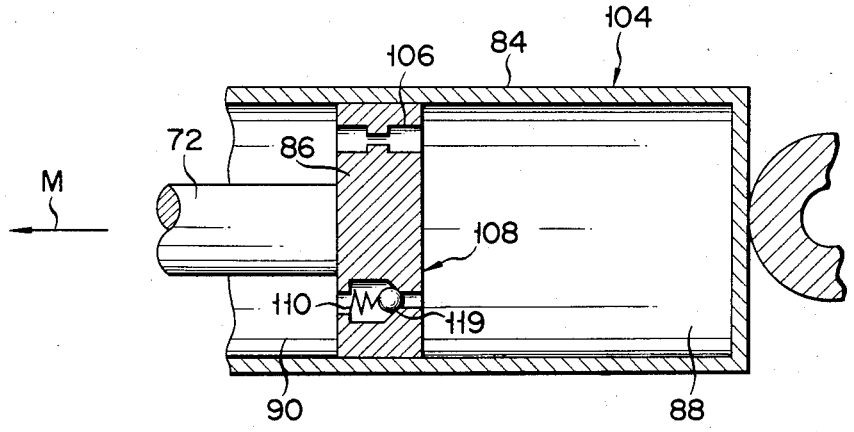
FIG. 10 is a partial sectional view of a gas spring used in a second embodiment of the invention.
Figure 11:
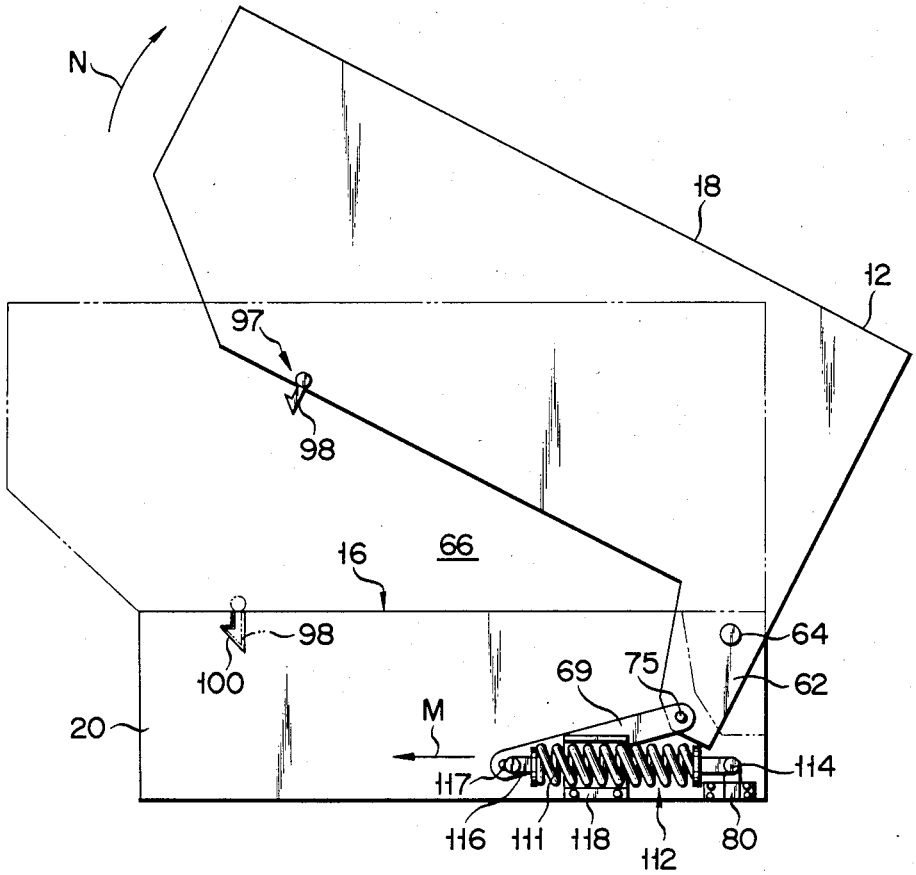
FIG. 11 is a side view schematically showing a housing apparatus according to a third embodiment of the invention used in the electronic copying machine shown in FIG. 2.

Referring now to FIGS. 2, 3 and 10, a second embodiment of the invention will be described. In this second embodiment, a gas spring 104 of another type is used in place of the gas spring 70 used for the urging device in the first embodiment. The construction of the second embodiment is the same as that of the first embodiment except for those characteristic portions of the gas spring 104 which are designated by additional reference numerals.

As shown in FIG. 10, an orifice 106 connecting the first and second chambers 88 and 90 is bored through the piston 86. The piston 86 is provided with a check valve 108 which allows gas only to flow from the first chamber 88 to the second chamber 90. The check valve 108 contains therein a ball 109 and a spring 110 which urges the ball 109 to block the opening of the first chamber 88.

According to this second embodiment, as the upper unit 18 is pressed down to be closed (i.e., as the piston 86 moves in the opposite direction of arrow M), the gas in the first chamber 88 is transferred to the second chamber 90 through the check valve 108 as well as the orifice 106. While the piston 86 moves in the opposite direction of arrow M, the resistance of the gas is lower than that of the movement in the direction of arrow M, therefore, the upper unit 18 can be pushed down with ease relatively.

Referring now to FIGS. 2, 11, 12 and 13, a third embodiment of the invention will be described. In this third embodiment, a first coil spring unit 112 is used in place of the gas spring 70 used for the urging device in the first embodiment. In the description to follow, like reference numerals are used to designate the same portions as used in the first embodiment. The first coil spring unit 112 is provided with a first cylindrical coil spring 111 which is compressed when the body 12 is closed. A fitting portion 114 for fixing the cylindrical coil spring 111 to the lower unit 20 is attached to one end of the spring 111. The other end of the cylindrical coil spring 111 is fitted with a coupling portion 116 which is connected to a link 69 by means of a pin 117. The first cylindrical coil spring 111 extends horizontally (substantially parallel to the conveyor path 16), and a guide member 118 for guiding the coil spring 111 along its extending direction surrounds the coil spring 111. When the upper unit 18 is closed, the first cylindrical coil spring 111 is compressed to accumulate an urging force to push up the upper unit 18 or to open the body 12. When the lock mechanism 97 is released, the first cylindrical coil spring 111 is stretched to open the body 12, thereby forming the space 66. Then, when the load of the upper unit 18 to close the space 66 balances with the urging force of the first cylindrical coil spring 111, the upper unit 18 ceases to swing in the direction of arrow N, and the space 66 is kept entire.

Figure 12:
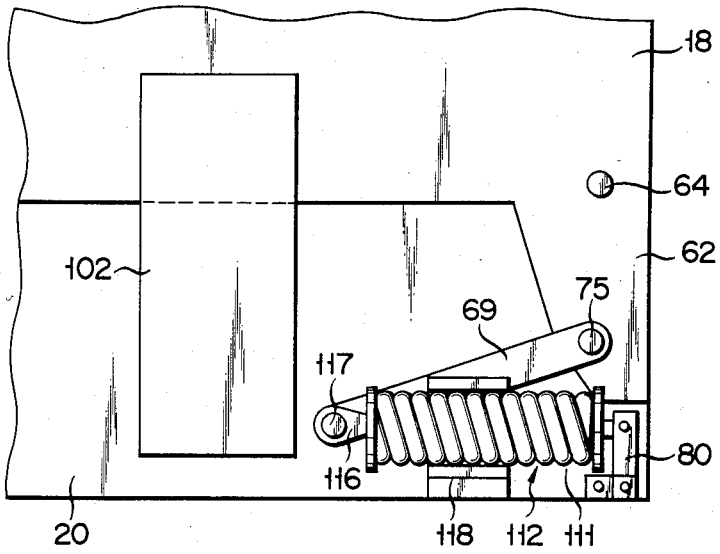
FIGS. 12 and 13 are partial side views of the housing apparatus for illustrating advantages of the third embodiment shown in FIG. 11.
Figure 13:
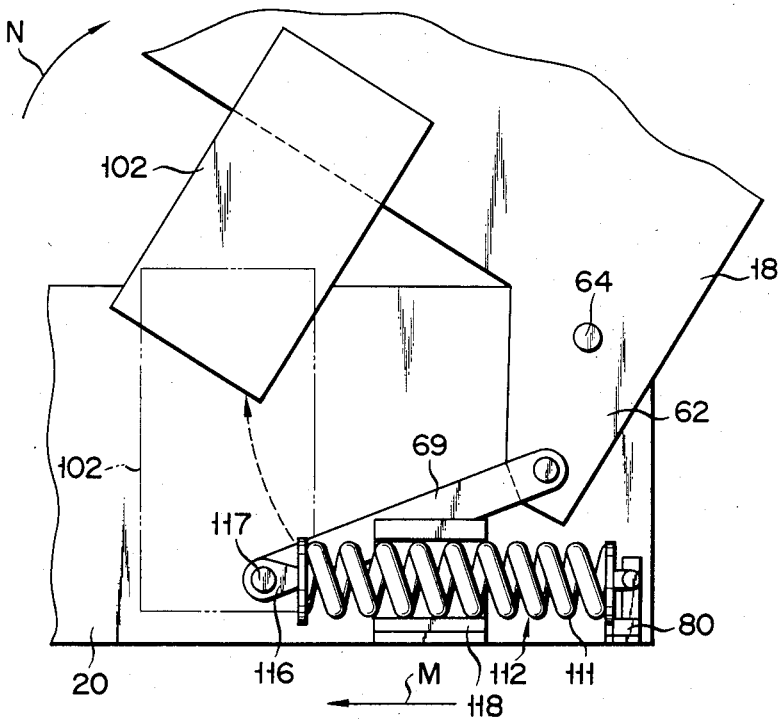

According to the third embodiment, as in the first embodiment, the space near the coil spring unit 112 can be used effectively. Namely, as shown in FIGS. 12 and 13, the accessory 102 may be attached to the upper unit 18 in the vicinity of the coil spring unit 112 without interfering with the coil spring unit 112.

According to the third embodiment, moreover, the use of the coil spring unit for the urging device makes the apparatus simple in construction and low in cost.

Figure 14:
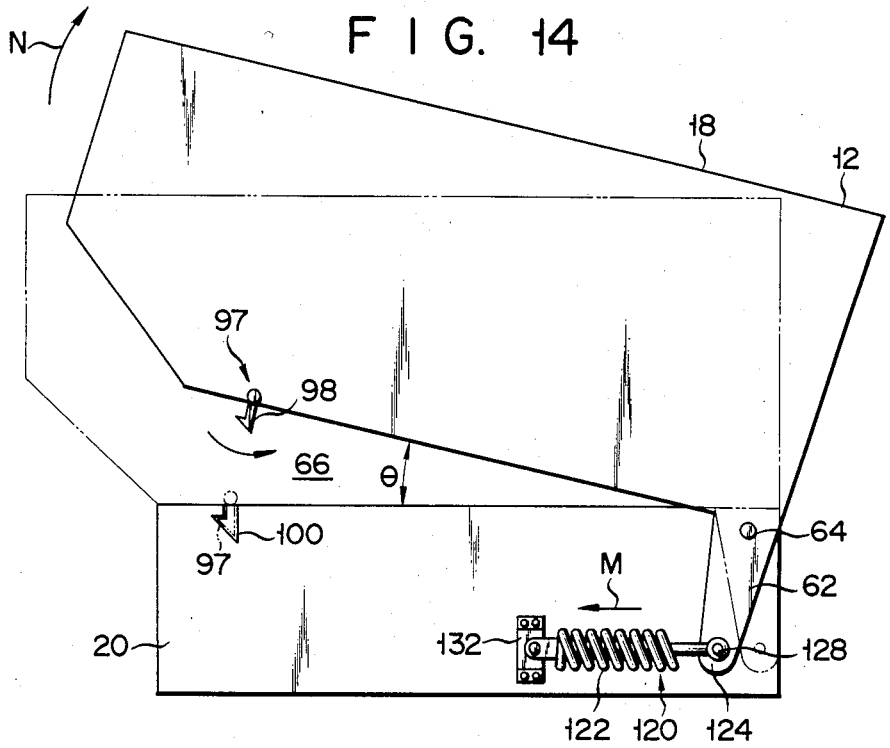
FIG. 14 is a side view schematically showing a housing apparatus according to a fourth embodiment of the invention used in the electronic copying machine shown in FIG. 2.

Referring now to FIGS. 2 and 14, a fourth embodiment of the invention will be described. In this fourth embodiment, a second coil spring unit 120 is used in place of the gas spring 70 used for the urging device in the first embodiment. In the description to follow, like reference numerals are used to designate the same portions as used in the first embodiment.

As shown in FIG. 14, the arm 62 is coupled at the extreme end with the second coil spring unit 120 including a second cylindrical coil spring 122 which is stretched when the upper unit 18 is open. One end portion 124 of the second cylindrical coil spring 122 rockably engages a hole 128 bored through the extreme end of the arm 62. The other end portion 130 of the second cylindrical coil spring 122 rockably engages a fitting device fixed to the lower unit 20. According to the fourth embodiment, the coil spring unit 120 used for the urging device can greatly be simplified in construction.

Referring now to FIGS. 2, 15, 16 and 17, a fifth embodiment of the invention will be described. In this fifth embodiment, a third coil spring unit 121 is used in place of the gas spring 70 used for the urging device in the first embodiment. In the description to follow, like reference numerals are used to designate the same portions as used in the first embodiment.

Figure 15:
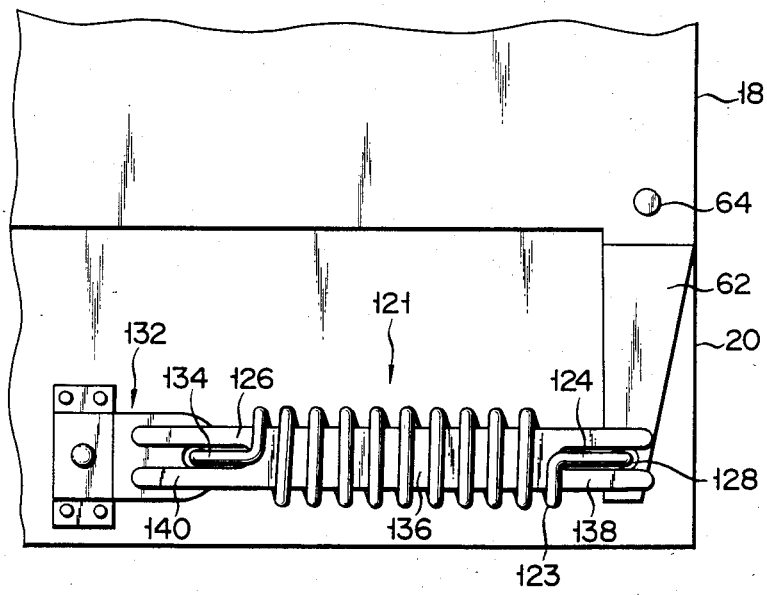
FIG. 15 is a side view schematically showing a portion including an urging device of a housing apparatus according to a fifth embodiment of the invention used in the electronic copying machine shown in FIG. 2.
Figure 16:
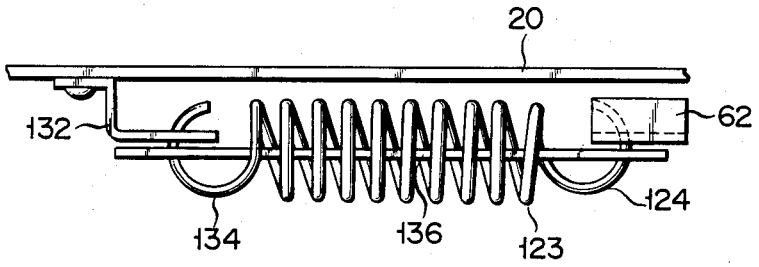
FIG. 16 is a front view schematically showing the portion including the urging device shown in FIG. 15.

As shown in FIG. 15, the third coil spring unit 121 is provided with a third cylindrical coil spring 123 which is stretched when the body 12 is closed, thereby applying an urging force to the upper unit 18.

Figure 17:
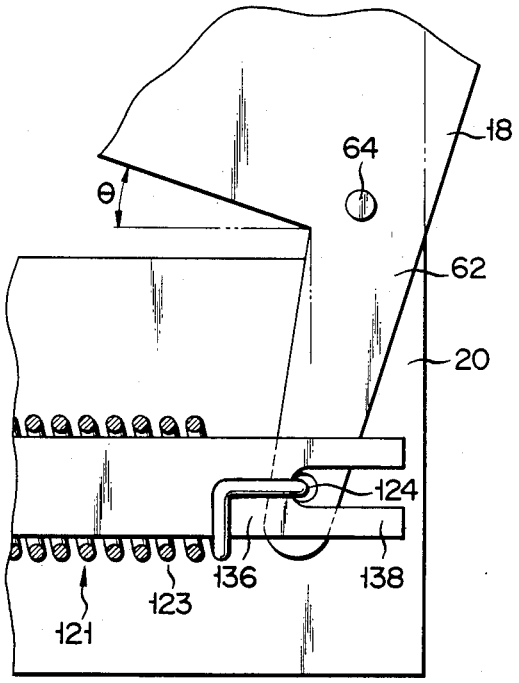
FIG. 17 is a partial side view for illustrating effects of the fifth embodiment.

A stopper 136 is provided inside the third cylindrical coil spring 123 to restrain the coil spring 123 from contracting to an excessive degree. The stopper 136 extends from the arm 62 to the fitting device 132. Slits 138 and 140 are formed individually in both end portions of the stopper 136. The opening angle $\theta$ of the upper unit 18 can be adjusted by adjusting the distance between the end slits 138 and 140. Thus, when the upper unit 18 is swung by the predetermined opening angle $\theta$ by the urging force of the third cylindrical coil spring 123, as shown in FIG. 17, the one end portion of the coil spring 123 engaging the extreme end portion of the arm 62 abuts against that portion of the stopper 136 which defines the slit 138. As a result, the upper unit 18 is prevented from swinging further.

According to the fifth embodiment, the swing angle or opening angle $\theta$ of the upper unit 18 can be kept constant so that the apparatus is prevented from being damaged by an excessive swing of the upper unit 18.

Further, the third coil spring unit 121 can easily be mounted by only coupling both end portions thereof to a hole 128 bored through the arm 62 and a hole 134 formed in the fitting device 132, individually.

It is to be understood that the present invention is not limited to those embodiments described above, and that various changes and modifications may be effected therein by one skilled in the art without departing from the scope or spirit of the invention.

In the embodiment described above, the housing apparatus is used in an electronic copying machine. Alternatively, however, the housing apparatus of the invention may effectively be used in facsimiles and other printing apparatuses, banking machines, etc.

In the aforementioned embodiments, moreover, an abutting member to restrict the contraction of the coil spring is used for the stopper for regulating the opening angle of the upper unit. Alternatively, however, an abutting member to restrict the extension of the coil spring may be used for this purpose. In this case, the urging force of the coil spring acts in the direction of its extension.

In the aforementioned embodiments, furthermore, the gas spring and cylindrical coil springs are described as the urging means. These springs may, however, be replaced with a conical coil spring or an elastic material such as rubber.

What is claimed is:

1. A copying apparatus comprising:

a sheet conveyance path having a feed end and a discharge end;

means for conveying a sheet along said path from the feed to the discharge end;

means for forming an image on said sheet as said sheet is conveyed along said path;

a first housing;

a second housing mating with said first housing at the level of said conveyance path, said conveyance path, conveyance means and forming means being disposed within said first and second housings;

an arm section extending from the first housing toward and onto the second housing and having a proximal portion and a free end portion;

coupling means, provided within the second housing and mounted at one of said feed and discharge ends of said conveyance path, for rotatably coupling the proximal portion of the arm section to the second housing to support the first housing and for supporting the proximal portion of the arm section; and urging means, provided on the second housing and coupled to the free end portion of the arm section, said urging means for applying a predetermined urging force to the free end portion of the arm section to maintain the first housing in a predetermined position in which a space for exposing the conveyance path is formed between the first and second housings, when the first housing is rotated about the coupled means by a predetermined angle with respect to the second housing.

2. An apparatus according to claim 1, further including locking means for engaging the first and second housings when the first and second housings mate with one another, thereby keeping the first and second housings in a closed position such that the two housings mate with one another.

3. An apparatus according to claim 2, wherein said locking means includes a retaining click attached to the first housing and means for defining a recess in the second housing and capable of engaging the retaining click.

4. An apparatus according to claim 1, wherein said urging means includes a gas spring comprising a cylinder in which compressed gas is sealed, a piston slidably disposed within the cylinder, and a piston rod having one end portion connected to one end of the piston and the other end portion coupled to the free end portion of the arm section to apply the predetermined urging force thereto, said piston dividing the interior of the cylinder into a first chamber on the side of the free end portion of the piston rod and a second chamber on the opposite side thereof, and including means for defining a hole connecting the first and second chambers, whereby the piston rod is normally urged in the direction of the first chamber with a relatively small spring constant.

5. An apparatus according to claim 4, wherein said piston is provided with a check valve allowing gas to flow from the first chamber to the second chamber, whereby the piston moves toward the first chamber against the urging force when a relatively small force is applied thereto.

6. An apparatus according to claim 5, wherein:

said gas spring is fixed to the second housing so that the longitudinal axis of the piston rod is substantially parallel to a horizontal line, and said apparatus further includes a link coupled between the free end portion of the arm section and the other end portion of the piston rod, the free end portion being urged to rotate about the coupling means by the urging force of the piston rod.

7. An apparatus according to claim 1, wherein said urging means includes a coil spring one end portion of which is rockably coupled to the free end portion of the arm section and the other end portion of which is rockably coupled to the second housing, whereby the free end portion is urged to rotate around the coupling means.

8. An apparatus according to claim 7, wherein said coil spring is extended to a length such that the coil spring exerts an urging force in a contracting direction, and has one end portion rockably coupled to the free end portion of the arm section and the other end portion rockably coupled to the second housing.

9. An apparatus according to claim 8, wherein said urging means includes movement limiting means for preventing the coil spring from contracting after the coil spring is contracted to a predetermined length, whereby the rocking angle of the first housing is restricted.

10. An apparatus according to claim 9, wherein said limiting means includes a plate member disposed inside the coil spring, said plate member including means for defining slits at both end portions thereof for guiding respective ends of the coil spring, and abutting portions adapted to abut against each corresponding end portion of the coil spring when the coil spring is contracted to the predetermined length.

11. An apparatus according to claim 7, wherein a line axial to said coil spring is substantially parallel to the horizontal line, and in contracted to a length such that the coil spring has an urging force in an extended direction, said coil spring having one end portion coupled to the free end portion of the arm section by means of a link, and the other end portion fixed to the second housing, so that the free end portion is urged to rotate about the coupling portion by the urging force of the coil spring.

12. An apparatus according to claim 11, wherein said urging means includes a guide member extending along the axis of the coil spring to guide the coil spring in its axial movement.

13. A shell-type housing including:

a lower enclosure including means for defining a first rectangular opening and means for defining first and second parallel surfaces exterior to said enclosure;

an upper enclosure including:

means for defining a second rectangular opening having substantially the same dimensions as those of the first opening, and means for defining first and second members extending from a first pair of adjacent corners of said second opening, said first member including means for defining a first surface, said second member including means for defining a second surface, said first and second surfaces opposing one another, the space between said first member first surface and said second member second surface being substantially the same as the spacing between said first and second surfaces exterior to said lower enclosure;

journalling means for rotatably journalling said first member to said first exterior surface and for rotatably journalling said second member to said second exterior surface, said journalling means permitting said upper enclosure to rotate with respect to said lower enclosure between at least a closed position whereat said first and second opening-defining means contact one another and said first and second openings are in registration with one another, and an upper position whereat a gap is defined between said upper and lower enclosures, said gap increasing in size from said first adjacent pair of corners of said second opening to the other pair of corners of said second opening; and urging means for urging said upper enclosure towards said raised position, said urging means including at least first biasing means for producing a force, said first biasing means having a first end fixed to said first member and a second end fixed to said first exterior surface, wherein:

said first member comprises a planar, substantially rectangularly-shaped extending piece integral to said upper housing and adjoining said second opening-defining means of said upper housing in proximity to a line passing through the vertices of said first adjacent pair of corners, said first member defining an extremity, said housing further includes means for rotatably jouralling said first biasing means first end to said extremity of said first extending piece, and said journalling means is coupled to said upper housing at the portion of said first extending piece adjoining said second opening-defining means.

14. A housing as in claim 13 wherein said urging means further includes first linking means for connecting said first biasing means to said first member, said first linking means including an elongated member rotatably journaled at a first end thereof to the extremity of said first member and rotatably journaled at a second end thereof to said first biasing means first end.

15. A housing as in claim 14 wherein:

said first biasing means comprises a first elongated spring assembly; and the angle between said first linking means and said first spring assembly is acute and varies with the position of said upper enclosure with respect to said lower enclosure.

16. A housing as in claim 13 wherein said urging means produces a predetermined force selected in accordance with the width of the gap between said upper and lower enclosures when said upper enclosure is in said raised portion.

17. A copying apparatus of the type including a sheet conveyance path having a feed end and a discharge end, means for conveying a sheet along said path from the feed end to the discharge end of said path, and means for forming an image on the sheet as the sheet is conveyed along said path, an improvement comprising:

a lower enclosure including means for defining a first rectangular opening and means for defining first and second parallel surfaces exterior to said lower enclosure;

an upper enclosure including:

means for defining a second rectangular opening having substantially the same dimensions of those of the first opening, and means for defining first and second members extending from a first adjacent pair of corners of said second opening, said first member including means for defining a first surface, said second member including means for defining a second surface, said first and second surfaces opposing one another, the spacing between said first member first surface and said second member second surface being substantially the same as the spacing between said first and second surfaces exterior to said lower enclosure;

means, disposed within said upper enclosure, for defining an upper portion of a sheet conveyance path;

means, disposed within said lower enclosure, for defining a lower portion of said sheet conveyance path;

journalling means for rotatably journalling said first member to said first exterior surface and for rotatably journalling said second member to said second exterior surface, said journalling means permitting said upper enclosure to rotate with respect to said lower enclosure between a closed position whereat said upper path-defining means is in contact with said lower path-defining means and an upper position whereat a gap is defined between said upper and lower enclosures, said gap increasing in size from one of the feed and discharge ends of said path to the other of said ends; and urging means for urging said upper enclosure towards said raised position, said urging means including at least first biasing means for producing a force, said first biasing means having a first end fixed to said first member and a second end fixed to said first exterior surface, wherein:

said first member comprises a planar, substantially rectangularly-shaped extending piece integral to said upper housing and adjoining said second opening-defining means in proximity to said one of said feed and discharge ends of said path, said first member defining an extremity;

said housing further includes means for rotatably journalling said first biasing means first end to the extremity of said first extending piece; and said journalling means is coupled to said upper housing at the portion of said first extending piece adjoining said second opening-defining means.

18. A apparatus as in clam 17 wherein said urging means further includes first linking means for connecting said first biasing means to said first member, said first linking means including an elongated member rotatably journaled at a first end thereof to the extremity of said first member and rotatably journaled at a second end thereof to said first biasing means first end.

19. An apparatus as in claim 18 wherein:

said first biasing means comprises a first elongated spring assembly; and the angle between said first linking means and said first spring assembly is acute and varies with the position of said upper enclosure with respect to said lower enclosure.

20. An apparatus as in claim 17 wherein said urging means produces a predetermined force selected in accordance with the width of said gap when said upper enclosure is in said raised position.

* * * * *